US012491402B2

(12) United States Patent
Brokaw

(10) Patent No.: US 12,491,402 B2
(45) Date of Patent: Dec. 9, 2025

(54) FOLDING EXERCISE BOARD AND METHODS OF USING SAME

(71) Applicant: Ian Brokaw, Farmington, CT (US)

(72) Inventor: Ian Brokaw, Farmington, CT (US)

( * ) Notice: Subject to any disclaimer, the term of this patent is extended or adjusted under 35 U.S.C. 154(b) by 215 days.

(21) Appl. No.: 18/323,784

(22) Filed: May 25, 2023

(65) Prior Publication Data

US 2023/0381574 A1 Nov. 30, 2023

Related U.S. Application Data

(60) Provisional application No. 63/346,008, filed on May 26, 2022.

(51) Int. Cl.
*A63B 21/00* (2006.01)
*A63B 71/00* (2006.01)

(52) U.S. Cl.
CPC ..... *A63B 21/4033* (2015.10); *A63B 71/0036* (2013.01); *A63B 2208/0252* (2013.01); *A63B 2210/50* (2013.01)

(58) Field of Classification Search
CPC ..... A63B 21/00047; A63B 21/1672; A63B 21/4029; A63B 21/4033; A63B 21/4037; A63B 71/0036; A63B 2208/0242; A63B 2208/0252; A63B 2210/00; A63B 2210/50; A63B 2225/09
See application file for complete search history.

(56) References Cited

U.S. PATENT DOCUMENTS 2,201,890 A * 5/1940 Dunn ..... A61G 1/013 5/628
2,658,754 A * 11/1953 Courtney ..... A61G 13/105 108/1
2,675,564 A * 4/1954 Hughes ..... A61G 1/01 5/628
3,648,305 A * 3/1972 Ersek ..... A61G 1/01 5/601
4,478,413 A * 10/1984 Siwula ..... A63B 21/0455 482/123

(Continued)

FOREIGN PATENT DOCUMENTS

CA 2717313 A1 4/2012
EP 3288427 B1 3/2021

(Continued)

OTHER PUBLICATIONS

Bound Tree, Blackboards, "Folding Backboard" and the "Ultra-Spac-Sav Backboards", https://www.boundtree.com/backboards/c/101, 26 pages, printed on Nov. 1, 2023.

*Primary Examiner* — Gary D Urbiel Goldner
(74) *Attorney, Agent, or Firm* — UConn IP Law Clinic; Megan Frayne; Curtis Rew

(57) ABSTRACT

An exercise board is disclosed comprising a foldable rigid support component of sufficient length to support a user lying horizontally, the rigid support component comprising at least a first segment and a second segment with each segment comprising an upper side surface and a lower side surface, at least one hinge connecting the first segment and second segment of the rigid support component and a cushion mounted to the upper side surface of each segment of the rigid support component. Methods of using the board are also described.

20 Claims, 9 Drawing Sheets

(56) References Cited

U.S. PATENT DOCUMENTS 4,574,101 A * 3/1986 Tricca ..... B32B 5/18 428/318.6
4,979,732 A * 12/1990 Rushatz ..... A61H 1/0237 482/148
5,190,056 A * 3/1993 Hull ..... A61F 5/05883 128/870
5,934,282 A * 8/1999 Young, III ..... A61G 1/00 128/870
6,110,083 A * 8/2000 Riser ..... A63B 21/4013 482/142
7,207,932 B1 * 4/2007 Dean ..... A63B 23/0211 482/148
7,303,705 B2 12/2007 Panton, Jr.
8,613,690 B1 * 12/2013 Thompson ..... A63B 21/00043 482/10
8,713,731 B2 5/2014 Kenalty
8,813,277 B2 8/2014 Ahlman
9,901,502 B2 * 2/2018 Rosario, Jr. ..... A63B 21/4034
10,744,361 B2 * 8/2020 Duval ..... A63B 21/4037
10,864,399 B2 12/2020 Lagree et al.
10,940,354 B2 * 3/2021 Oltorik, Jr. ..... A63B 21/4043
2003/0200972 A1 * 10/2003 Crutchfield ..... A61G 1/04 5/601
2005/0046128 A1 3/2005 Lehr
2007/0087920 A1 * 4/2007 Dachraoui ..... A63B 21/0552 482/121
2007/0155495 A1 7/2007 Goo
2008/0118671 A1 * 5/2008 Bienkiewicz ..... A63B 21/4037 428/12
2014/0256476 A1 * 9/2014 Sallinen ..... A63B 21/4037 473/446
2020/0282257 A1 * 9/2020 Essex ..... A63B 21/4037
2022/0001231 A1 * 1/2022 Fiducia ..... A63B 21/4037
2022/0296958 A1 * 9/2022 Rupaka ..... A63B 71/0036
2023/0285798 A1 * 9/2023 Zanyk ..... A63B 21/00047

FOREIGN PATENT DOCUMENTS

KR 20130031814 A * 3/2013
WO 2004096107 A1 11/2004
WO WO-2012051593 A2 * 4/2012 ..... A63B 21/0442

* cited by examiner

Fig. 4
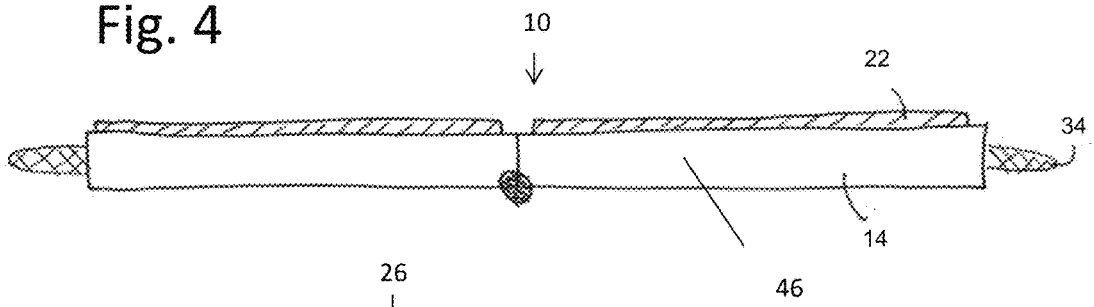
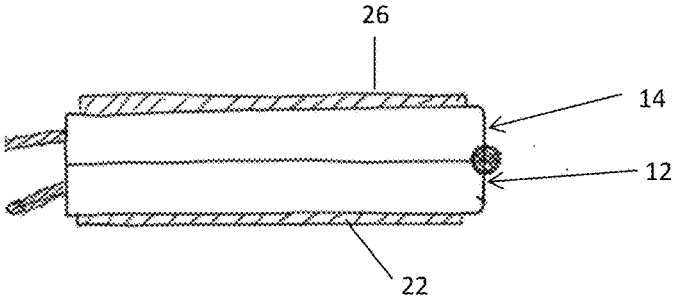
Fig. 5
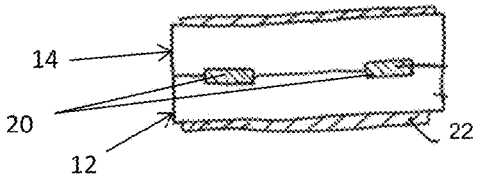
Fig. 6
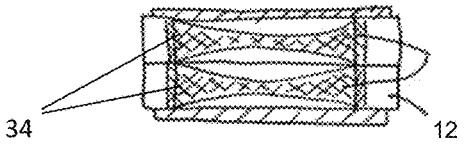
Fig. 7
Fig. 8
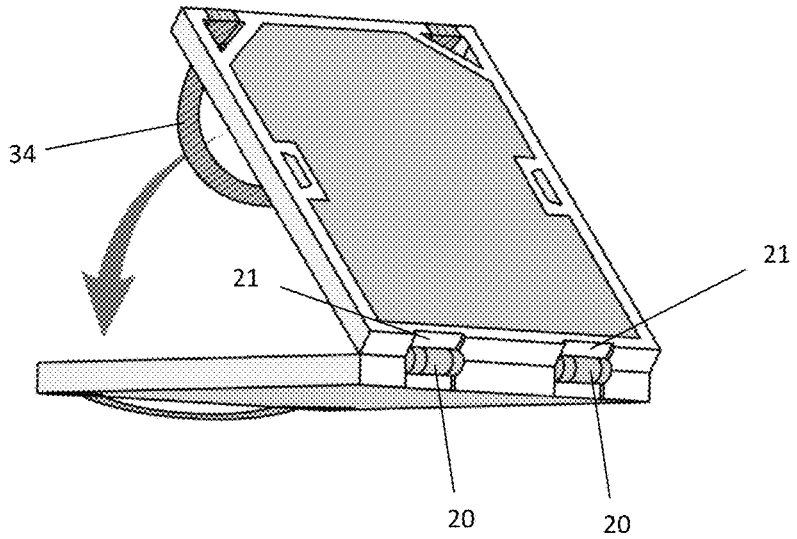

Fig. 13
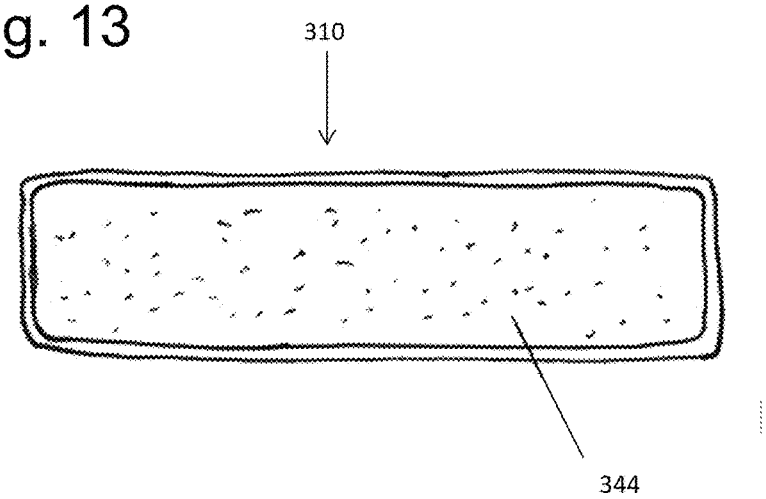
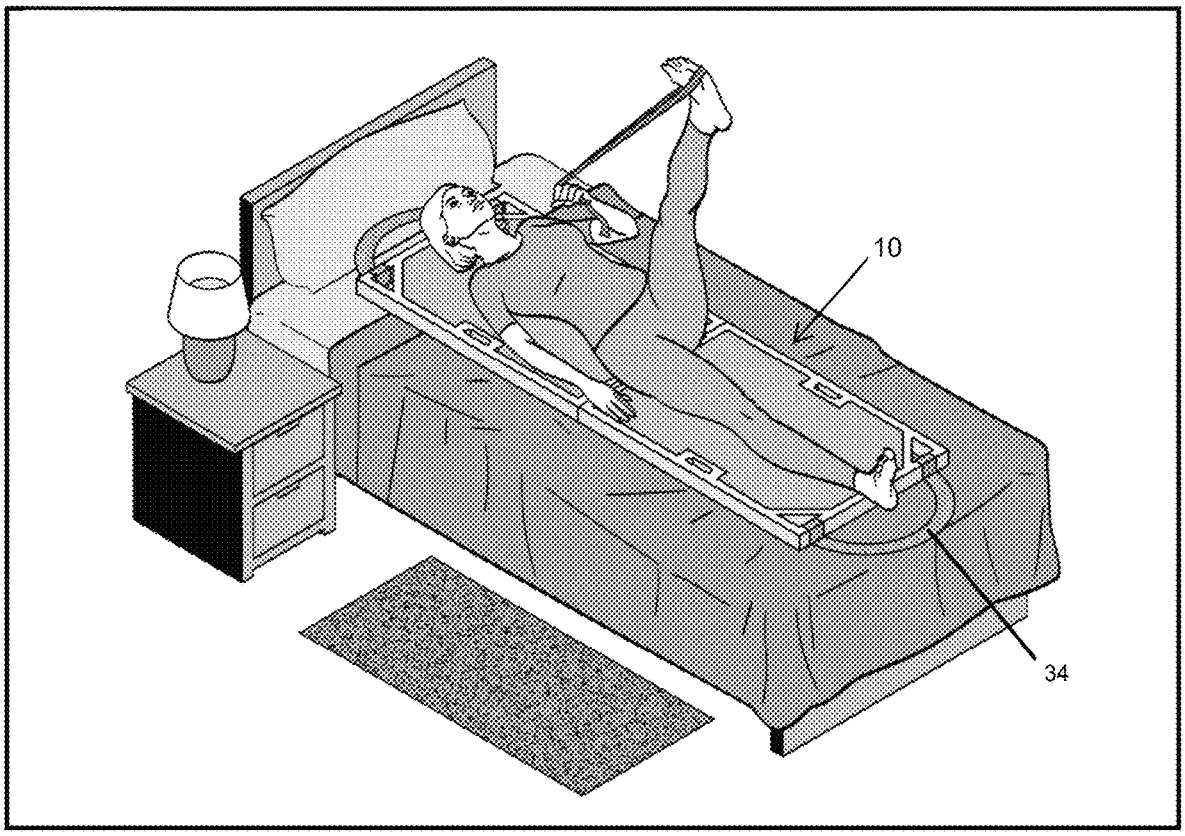
Fig. 14

FOLDING EXERCISE BOARD AND METHODS OF USING SAME

CROSS-REFERENCE TO RELATED APPLICATIONS

This application claims the benefit of U.S. Provisional Patent Application No. 63/346,008, filed May 26, 2022, the contents of which are incorporated by reference herein in their entirety.

BACKGROUND

This disclosure relates generally to exercise equipment, and more particularly to folding exercise boards usable on unstable surfaces.

Individuals recovering from injury or with limited mobility need to exercise to gain or maintain their physical strength. It is problematic if one is unable to leave their bed to access exercise equipment located elsewhere, which makes exercising in a safe and meaningful way challenging.

It would be useful to develop a portable apparatus that enables exercise on unstable surfaces.

SUMMARY

One embodiment described herein is an exercise board comprising a foldable rigid support component of sufficient length to support a user lying horizontally, the rigid support component comprising at least a first segment and a second segment with each segment comprising an upper side surface and a lower side surface. There is at least one hinge connecting the first segment and second segment of the rigid support component with a cushion mounted to the upper side surface of the rigid support component.

Another embodiment described herein is a rigid support component of the exercise board comprising an exterior layer and an interior reinforcing structure within the rigid support component. The interior reinforcing structure can be constructed of a polymer, metal, foam, composite material, or a combination thereof.

Yet another embodiment described herein is an exercise board comprising: a foldable rigid support component of sufficient length to support a user lying horizontally, the rigid support component comprising a first segment, a second segment, and a third segment with each segment comprising an upper side surface and a lower side surface. At least one hinge connects the first segment and second segment of the rigid support component and at least one hinge connecting the second segment and third segment of the rigid support component. A cushion mounted to the upper side surface of each segment of the rigid support component.

Yet another embodiment is a method of using an exercise board comprising the steps of: obtaining a folded exercise board, unfolding the exercise board into its fully extended position, placing the extended exercise board on a bed or other platform, orienting the cushion side up, and locking the hinge. In embodiments, the method further comprises the step of engaging in exercise atop the extended mat. In some cases, the method further comprises the steps of folding the exercise board into a folded position and placing the folded exercise board in a storage location. In embodiments, the method further comprises the step of placing the folded exercise board into a specially designed bag.

In some embodiments the rigid support component comprises a first segment and a second segment. The segments are hinged along the axis of the width of the board. There is at least one hinge connecting the first segment and second segment of the rigid support component with a cushion mounted to the upper side surface of the rigid support component. A method of making the exercise board also is disclosed.

In some embodiments the rigid support comprises a first segment, a second segment, and at least one more segment. The segments are hinged along the axis of the width of the board. There is at least one hinge connecting the first segment and second segment of the rigid support component, and at least one hinge connecting the second segment and third segment, and at least one hinge connecting any additional segments, of the rigid support component. A cushion is mounted to the upper side surface of each segment of the rigid support component.

In some embodiments the rigid support segments have holes, hooks, ties, VELCRO® loops or magnetic or traditional buckles to fasten an exercise resistance apparatus to the board. In some embodiments the resistance apparatus will be attached to a harness to go around portions of the user's body. In some embodiments, the resistance apparatus will have endpoints adapted for gripping. In some embodiments, the resistance apparatus will have loops with or without handgrips for the user to grip.

BRIEF DESCRIPTION OF THE DRAWINGS

The drawings illustrate the design and utility of preferred embodiments, in which similar elements are referred to by common reference numerals.

FIG. 4 is a first side view of the first embodiment.

FIG. 5 depicts the first embodiment in folded configuration from the first side view.

FIG. 6 depicts the first embodiment in folded configuration from the central view.

FIG. 7 depicts the first embodiment in folded configuration from the end view.

FIG. 8 shows a perspective view of a first embodiment as it would transition into its folded configuration.

FIG. 13 is a cross-sectional view of the second embodiment with interior reinforcing foam.

FIG. 14 is a perspective view of the first embodiment during use.

DETAILED DESCRIPTION

The embodiments disclosed herein help spread the load of a user lying horizontally on an unstable surface making exercise accessible to the user and doing so safely. The exercise board can be used in all industries, but especially for physical therapy or general exercises to improve overall effectiveness of the movements being carried out to the benefit of the user. Users with limited mobility or injury may not be able to leave their bed to access exercise equipment located elsewhere. Even recovering or elderly individuals that can leave their beds and are relatively mobile may not be able to position themselves on the floor. A bed or sofa can be converted to a flat exercise surface with use of an exercise board. Exercising on top of an unstable surface like a bed without adequate support presents not only safety concerns for the user but is challenging for a physical therapist since proper positioning of the user and muscle isolation may not be possible. By having proper support, users could recover from injuries more quickly or continue to maintain their physical strength by improving the quality of their movements.

When not in use, the exercise board can be folded into a smaller size, portably relocated using the handles, a tote bag, or other suitable device, and stored for later use. In some cases, the rigid support structure of the exercise board comprises a base component constructed of high-density material that has a cushion layer formed to the upper side surface for user comfort while the user lays horizontally on the exercise board during use.

As used herein, the term "folded" means that the segments of the rigid support structure are connected with at least one pivot point, usually including a hinge, and fold towards each other to reduce the overall length of the exercise board.

Figure 1:
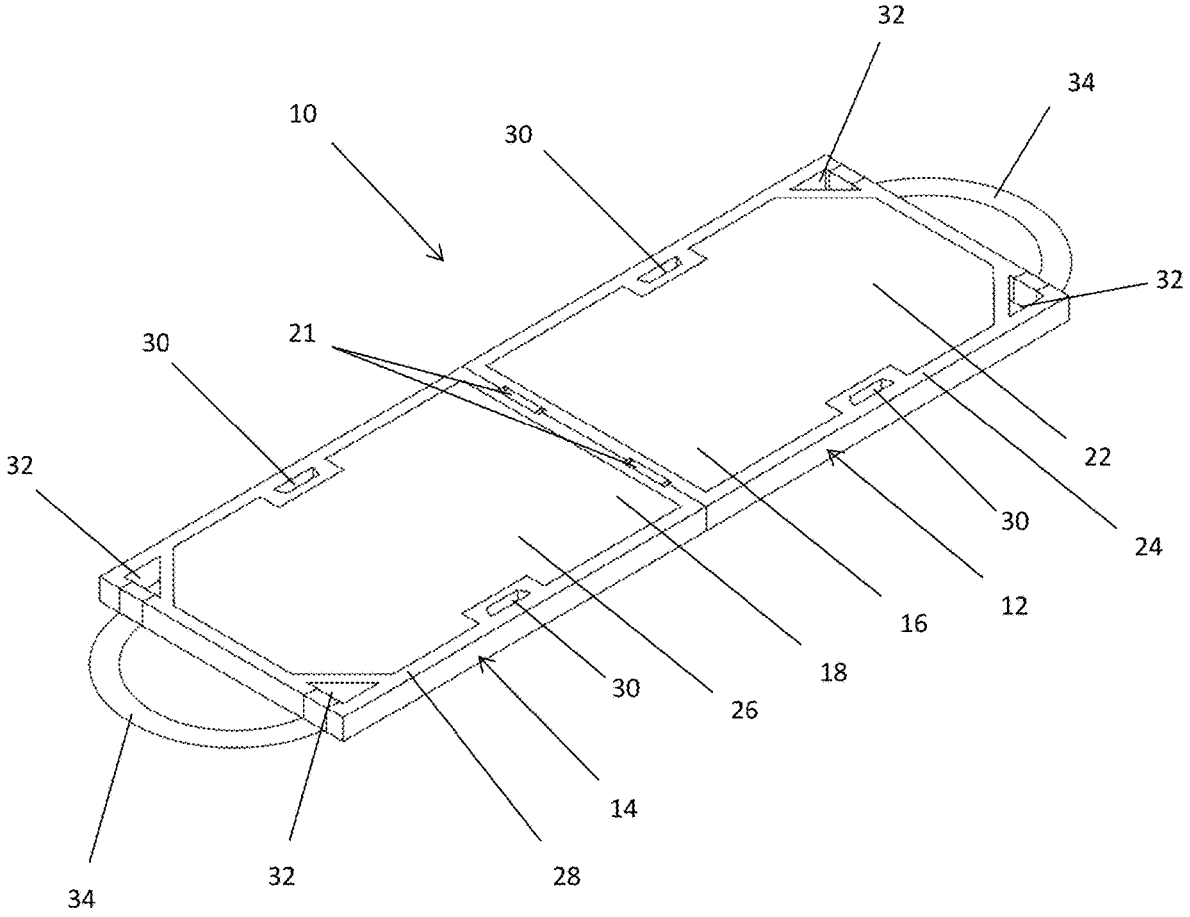
FIG. 1 shows a perspective view of a first embodiment in unfolded configuration.
Figure 2:
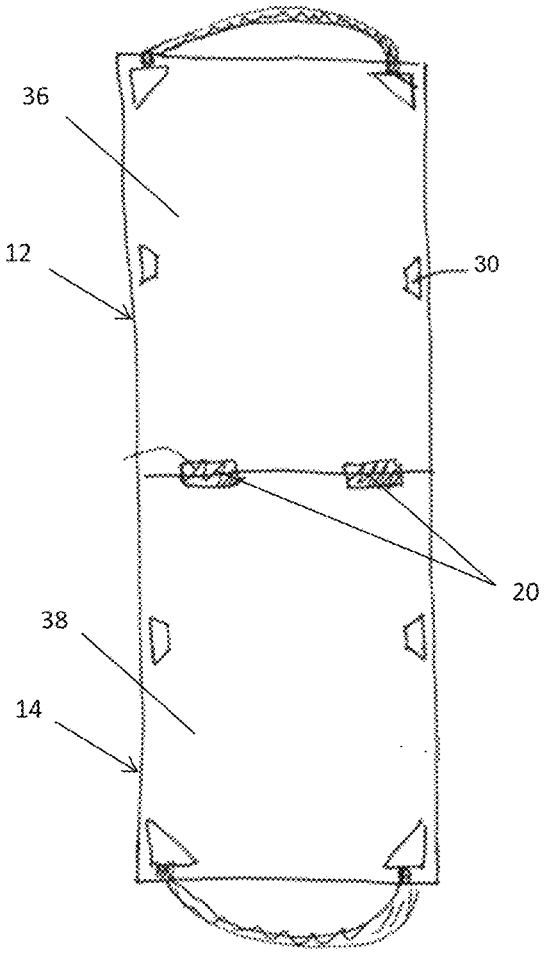
FIG. 2 is a bottom view of the first embodiment.
Figure 3:
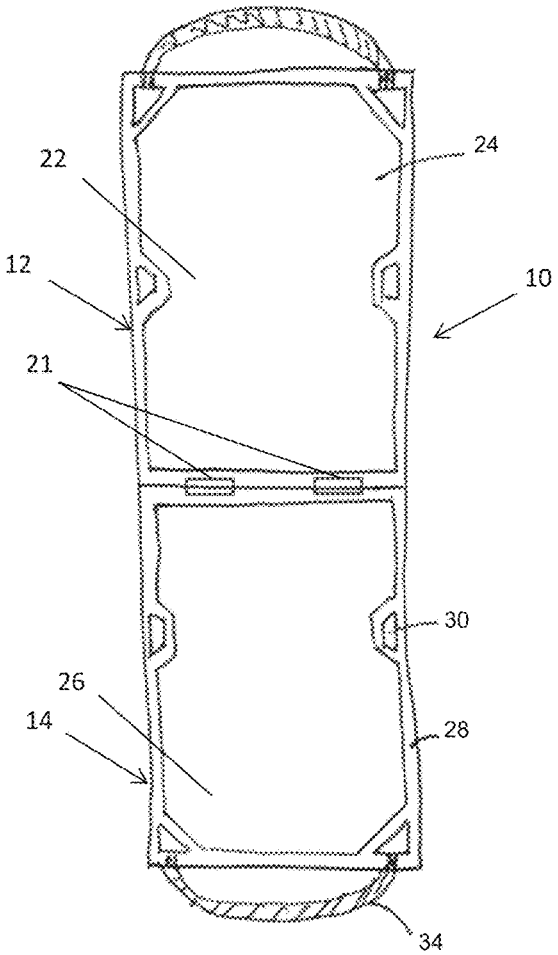
FIG. 3 is a top view of the first embodiment.

Referring to the drawings, FIGS. 1-8 show a foldable exercise board generally designated as 10. The board 10 includes a first segment 12 and a second segment 14 adjacent and connected to each other at the second end portion 16 of first segment 12 and first end portion 18 of second segment 14 by a hinge 20. The hinge 20 can be a bifold locking hinge used to secure segments 12 and 14 into a functional exercise board during use and fold the board into a smaller configuration during periods of non-use. While the figures show the use of two exposed hinges 20, one or more hinges can be used depending on the configuration. In some embodiments, the hinge is recessed within recesses 21 in the second end portion 16 of first segment 12 and the first end portion 18 of second segment 14 so that the hinges 20 are not readily visible from the top side when the board is in the unfolded configuration. In the embodiment shown in FIGS. 1-8, there is substantially no gap between and first segment 12 and the second segment 14 at a region of the exercise board 10 adjacent to the hinges 20 when the exercise board 10 is in both folded and unfolded configurations. Additionally, while the figures show the board being made from two segments, two, three, four, or more segments could be used to form the board. FIG. 2 shows the bottom view of board 10 with two hinges 20 on the lower side surface 36 of segment 12 and a lower side surface 38 of segment 14.

A first cushion 22 is mounted to a first upper side surface 24 of the first segment 12 and a second cushion 26 is mounted to a second upper side surface 28 of the second segment 14. Cushions 22 and 26 cover the entire upper side surfaces except areas with handholds and the region proximate the hinges 20. In some embodiments, a single continuous cushion could cover upper side surfaces 24 and 28 of segments 12 and 14, respectively. When the board is in its folded configuration, the embodiment with a continuous piece of cushion covering the upper side surfaces of segments 12 and 14 will stretch over the hinged first and second end portions of segments 14 and 12, respectively. In other embodiments, the cushion is recessed within the upper side surfaces 24 and 28 of segments 12 and 14. In certain embodiments not shown, the cushion segments 22 and 26 can contact each other at the region where the second end portion 16 and first end portion 18 align when the board is in the unfolded configuration. Cushions 22 and 26 may comprise a foam material (non-limiting examples including polyurethane, polyethylene, or a combination of like materials), and in some embodiments, may be covered with a non-porous wipeable material, including but not limited to vinyl. The cushion foam may have a density in the range of 1.8-30 pounds per cubic foot. The compressibility of the foam may be tested using ASTM D3574 B1 standards, or ASTM D3574-17 standards for urethane foams. In embodiments, the pressure required to compress the cushions 25% can be in the range of about 0.3-45 psi as measured ASTM D3574 B1 standards. The cushion could also be mechanically bonded to the segments or affixed using hook and loop fasteners. The cushion could also be attached to the board using elastic or nonelastic tethers that wrap around the corners of the board, are fastened to the board or pass through already existent or newly added loops.

The version of the board 10 shown in FIGS. 1-14 has a plurality of side handholds 30 located along the length of segments 12 and 14. Each handhold 30 is similarly structured with a size and shape that would render them ergonomically comfortable for a user in the user's hand. In some embodiments, the handholds may have a triangular, rectangular or trapezoidal shape. Additionally, while the figures show the segments of the board having one handhold located along the length of each segment 12 and 14, two, three, or more handholds could be located along the length of each segment. The handholds extend partially or completely through the thickness of the board, thereby defining openings to receive hands of the user during exercise or transport of the board.

In some cases, the board 10 has a plurality of corner handholds 32 located at the corners of the non-hinged end portion of segments 12 and 14. Each corner handhold 32 is similarly structured with an ergonomic shape to render them comfortable for a user in the user's hand. The corner handholds 32 extend partially or through the thickness of the board, thereby defining openings to receive hands of the user during exercise or transport of the board.

In some embodiments, the board 10 has flexible straps 34, which can be made of nylon or another thermoplastic material 34 connected to handholds 32 at the non-hinged end portions of segments 12 and 14, thus creating additional handles for the user to transport board 10.

FIGS. 5-8 illustrate the exercise board 10 in folded configuration from several perspectives. FIG. 5 shows the exercise board 10 from the side in the preferred embodiment with the cushion on the outside when the board is in folded configuration. When the exercise board 10 is folded in the preferred embodiment, a lower side surface 36 of segment 12 and a lower side surface 38 of segment 14 come together and overlay by folding along the rotational axis of hinge 20. In FIG. 7, the straps 34 are depicted as being elevated to show cushion 22, although the straps 34 generally will be in contact with the surface upon which the folded exercise board 10 rests.

The embodiment of FIGS. 1-8 may be manufactured by injection molding a solid piece of thermoplastic material, or compression molding a thermoset material into the desired size and shape of each segment of the exercise board. A cushion would then be formed to the upper side surface of each segment. The appropriate number of segments would then be aligned and connected using at least one hinge attached to the hinged end portion of each segment. Flexible straps may then be connected to the non-hinged end portions of the segments.

Figure 9:
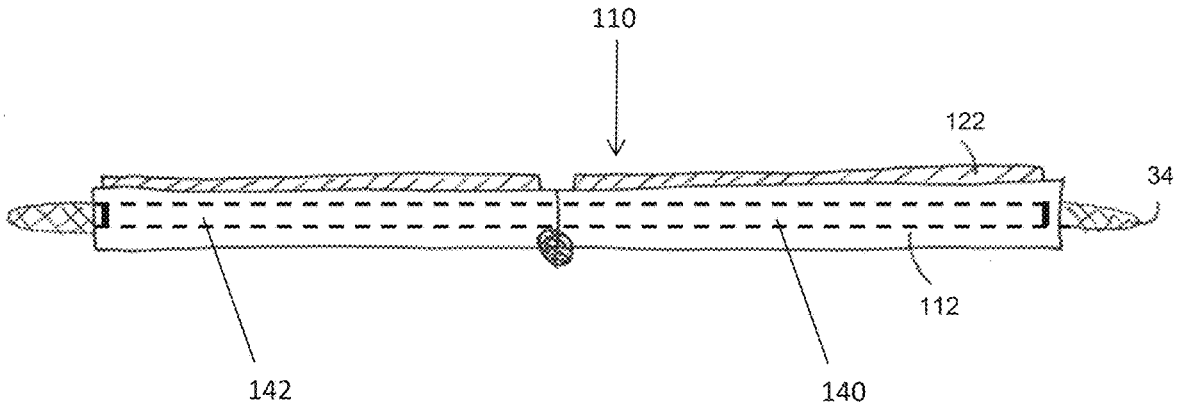
FIG. 9 is a first side view of a second embodiment with an interior reinforcing structure.
Figure 10:
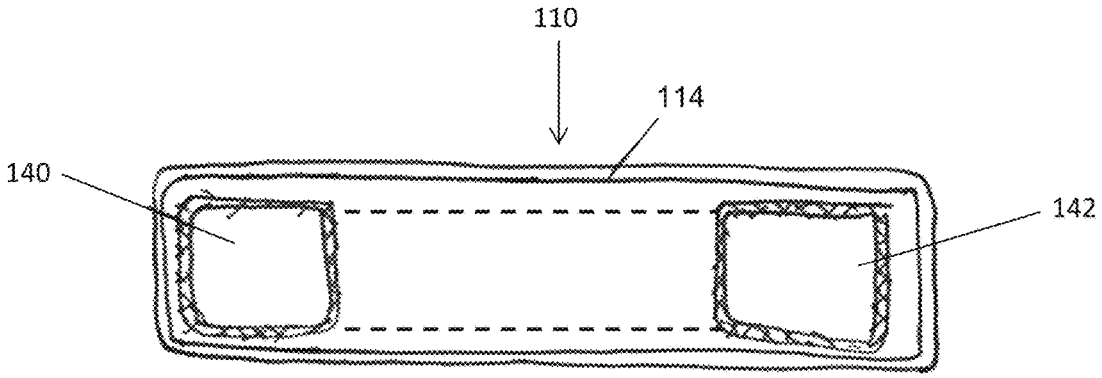
FIG. 10 is a cross-sectional view of the second embodiment.
Figure 11:
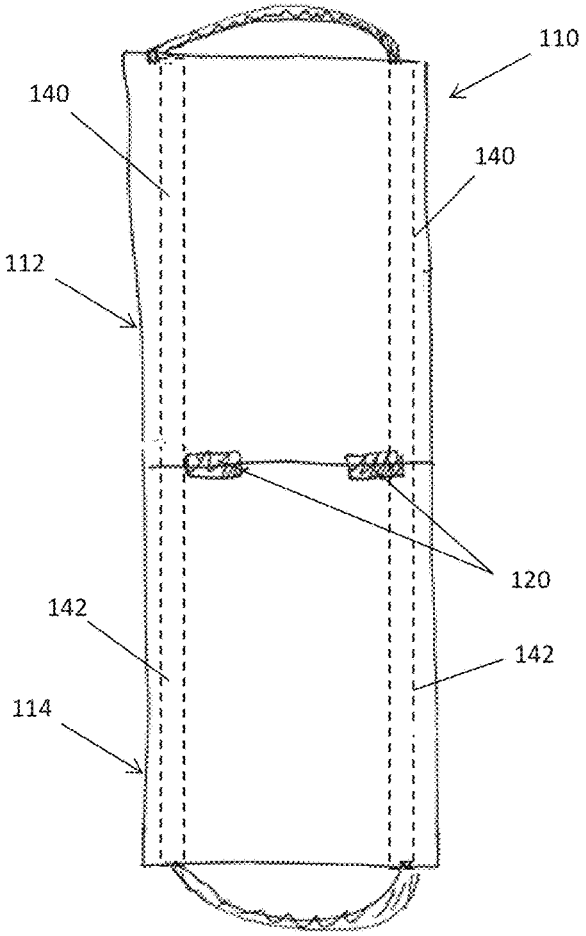
FIG. 11 is a bottom view of the second embodiment showing the position of the interior reinforcing structure with broken lines.

Referring to FIGS. 9-11, a second embodiment of a board 110 is shown from a side view in its unfolded configuration. The board 110 encompasses a two-piece interior reinforcing structure 140 extending the entire length of first segment 112 and a two-piece interior reinforcing structure 142 extending the entire length of second segment 114 from the first end portion to the second end portion of each segment. The first segment 112 is connected to the second segment 114 by two hinges 120. The interior reinforcing structure can be formed from tubing having a rectangular cross section or a circular cross section. FIG. 10 is a cross sectional view of board 110 showing the reinforcing structure with a rectangular cross section encompassed within the rigid support structure. The reinforcing frame structure may be made of a polymer, metal, foam, or composite material, or combination thereof.

Figure 12:
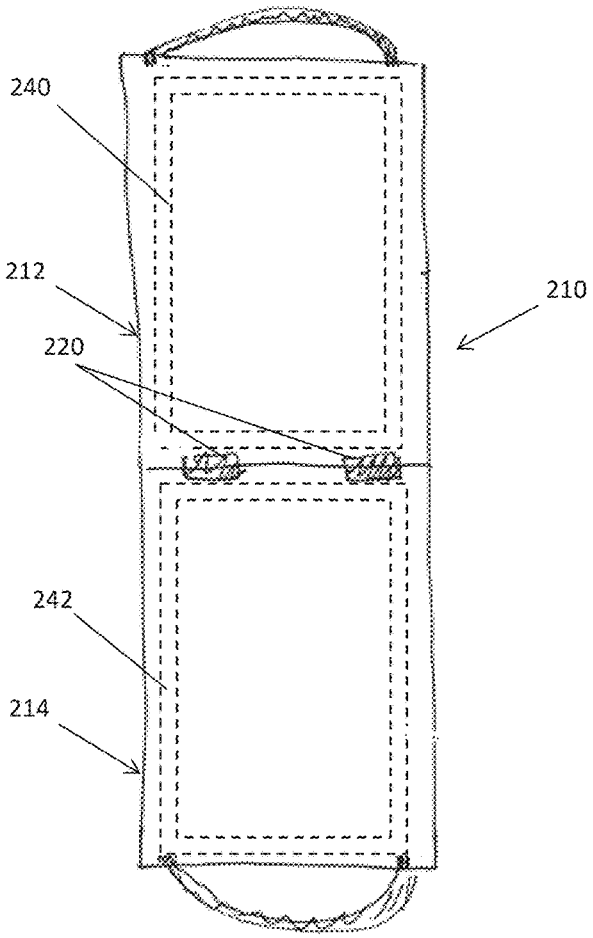
FIG. 12 is a bottom view of a third embodiment showing the position of the interior reinforcing structure with broken lines.

In some embodiments, including the third embodiment of the exercise board 210 shown in FIG. 12, the interior reinforcing structure extends across both the width and length of each segment of the exercise board. The broken lines show the general configuration of the interior reinforcing structure, which includes a first rectangular tubular frame 240 in first segment 212 and a second rectangular tubular structure 242 in second segment 214. The first segment 212 is connected to the second segment 214 by two hinges 220.

The embodiments of FIGS. 9-11 and 12 may be manufactured by injection molding thermoplastic material around an interior reinforcing structure fully enveloping the interior reinforcing structure, or compression molding a thermoset material around an interior reinforcing structure.

In some cases, the exercise board 310 contains a rigid foam 344, as is schematically depicted in a fourth embodiment shown in FIG. 13. The foam can be included to impart strength and/or to provide for a lighter weight board as compared to an exercise board formed from a solid thermoplastic or thermoset material. In some cases, the foam comprises polyurethane, polystyrene, and/or polyisocyanate. In embodiments, the board is injection molded or blow-molded and then filled with foam that is injected into the exercise board in liquid form and then expands to form a rigid foam core. The segments may be made of vacuum formed thermoplastic or thermoset material forming an exterior shell with a rigid foam filling the interior of each segment.

FIG. 14 illustrates use of the exercise board. The user unfolds the exercise board into its fully extended configuration, locking the hinge, and placing the board on an unstable surface orienting the cushioned side up. The user then lies horizontally on top of the board and engages in exercises. After use, the board can be put into its folded configuration and stored for later use.

Figure 15:
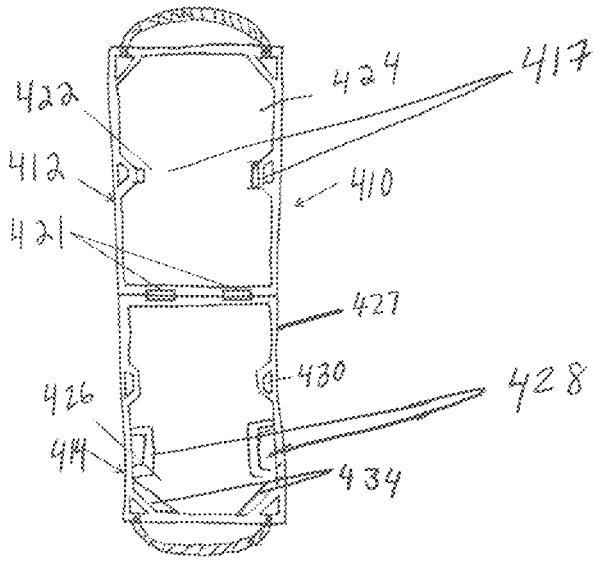
FIG. 15 is the top view of a fourth embodiment that includes holes wherein to tether elastic or nonelastic straps.

FIG. 15 shows the top view of a fourth embodiment 410 that includes side holes 417 and 428. FIG. 15 also includes corner holes 434. Holes 417, 428 and 434 contain space wherein to tether elastic or nonelastic straps. The use of elastic and nonelastic resistance bands, straps or belts is well documented in the field of Physical Therapy and Wellness. If the resistance apparatus is inelastic, in some cases, the length will range from 28 inches to 160 inches with width from 0.3 inches to 18 inches. If the resistance apparatus is elastic, in some cases, the length will range from 22 inches to 160 inches with width from 6 inches to 30 inches. These can be used singly or in combination. In some embodiments, the board will have holes, hooks, ties, VELCRO® loops or magnetic or traditional buckles to fasten the resistance apparatus to the board. Similar to the embodiment of FIGS. 1-8, this embodiment includes a first segment 412 and a second segment 414 connected by hinges disposed in recesses 421 that connect the two segments to one another. A first cushion 422 is mounted to the upper side surface 424 of a first segment 412 and a second cushion 426 is mounted to a second upper side surface 427 of the second segment 414. This embodiment includes side handholds 430.

Figure 16:
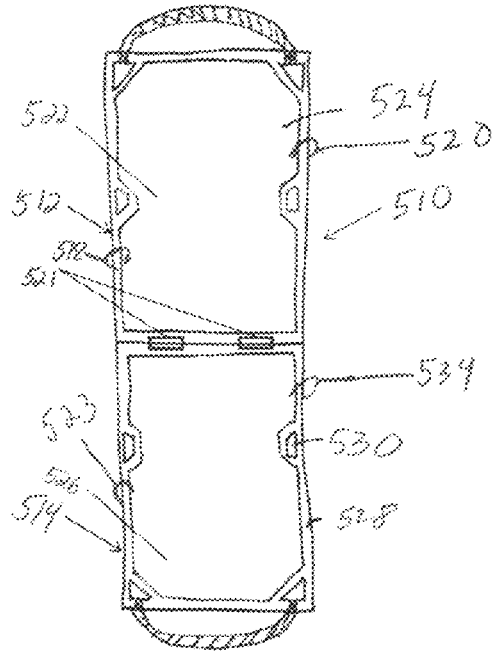
FIG. 16 is the top view of a fifth embodiment that includes hooks or loops wherein to attach elastic or nonelastic straps.
Figure 17:
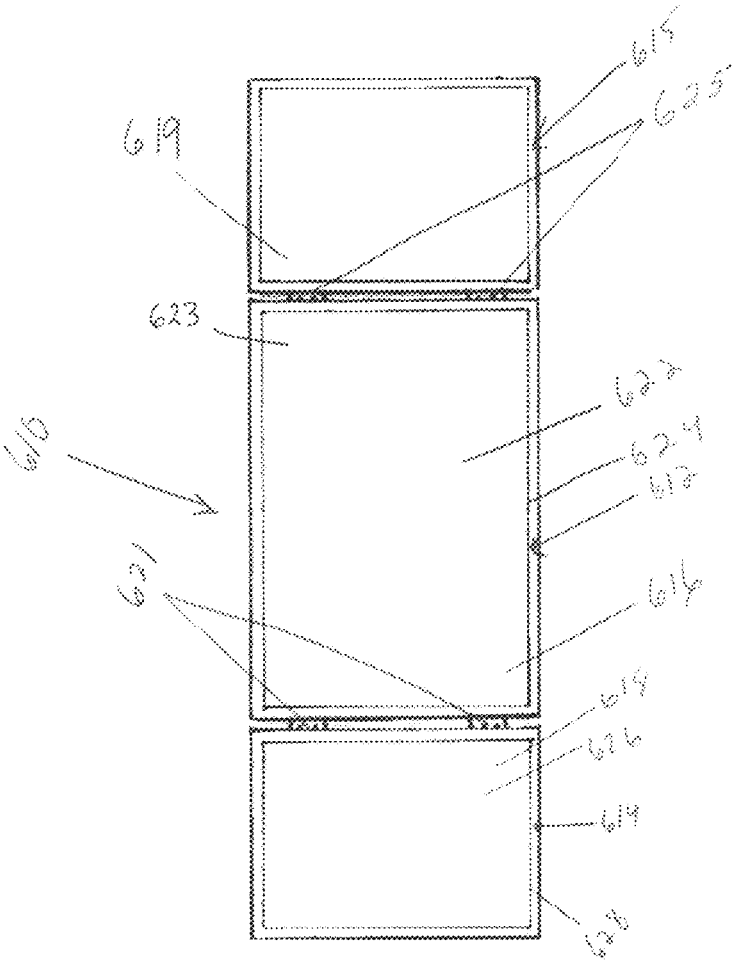
FIG. 17 is the top view of a sixth embodiment comprising three segments connected with hinges.

FIG. 16 shows the top view of a fifth embodiment 510 that includes protruding side hooks or loops 518 and 523 and protruding side hooks or loops 520 and 534 wherein to attach elastic or nonelastic straps. In some cases, the straps have the same dimensions as in FIG. 15. Similar to the embodiment of FIGS. 1-8, this embodiment includes a first segment 512 and a second segment 514 connected by hinges disposed in recesses 521 that connect the two segments to one another. A first cushion 522 is mounted to the upper side surface 524 of a first segment 512 and a second cushion 526 is mounted to a second upper side surface 528 of the second segment 514. This embodiment includes side handholds 530.

FIGS. 17-20 show a sixth embodiment of a foldable exercise board generally designated as 610. The board 610 includes a first segment 612, a second segment 614, and a third segment 615 adjacent and connected to each other. Segments 612 and 614 are connected at the second end portion 616 of first segment 612 and first end portion 618 of second segment 614 by a hinge 621. Segments 612 and 615 are connected at the second end portion 623 of first segment 612 and first end portion 619 of segment 615 by a hinge 625. The hinges 621 and 625 can be bifold locking hinges used to secure segments 614, 612 and 615 into a functional exercise board during use and fold the board into a smaller configuration during periods of non-use. While the figures show the use of two exposed hinges 621 and two exposed hinges 625, one or more hinges can be used for each separate connecting part depending on the configuration.

Figure 18:
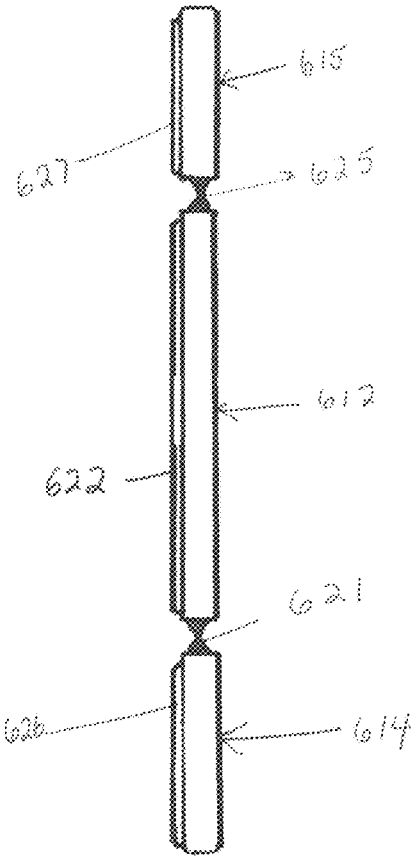
FIG. 18 is the first side view of the sixth embodiment when unfolded.
Figure 19:
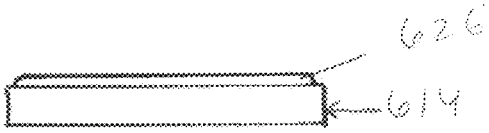
FIG. 19 is the end view of the sixth embodiment when unfolded.
Figure 20:
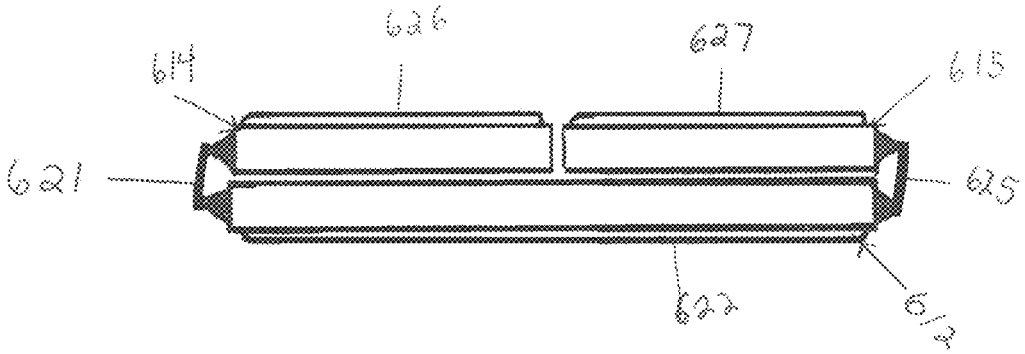
FIG. 20 is the first side view of the sixth embodiment when folded and closed.

In some embodiments, the hinge is recessed as in FIG. 1. Additionally, while the figures show the board being made from either two or three segments, three, four, or more segments could be used to form the board. FIG. 18 shows the first side view of board 610. FIG. 19 shows the end view of board 610. FIG. 20 shows the first side view of board 610 in the folded configuration.

A first cushion in FIGS. 17-20, 622 is mounted to a first upper side surface 624 of the first segment 612. A second cushion 626 is mounted to a second upper side surface 628 of the second segment 614. In some embodiments, a third cushion 627 is mounted to segment 615 in the same manner that the cushions are mounted to segments 614 and 612. Cushions 622, 626, and 627 cover the entire upper side surfaces except areas with handholds and it included the region proximate the hinges 621. In some embodiments, a single continuous cushion could cover upper side surfaces 624 and 628 of segments 612 and 614, respectively. In some embodiments this same cushion could also cover segment 615. When the board is in its folded configuration, the embodiment with a continuous piece of cushion covering the upper side surfaces of segments 612 and 614 and possibly 615 will stretch over the hinged first and second end portions of segments 614 and 612, and hinged first and third portions of segments 615 and 612, respectively. The recession, cushion contact, material, surface materials, density, and methods of attachment could be the same as the cushion in FIGS. 1-4 in different embodiments with three or more segmented embodiment illustrated in FIGS. 17-20.

Figure 21:
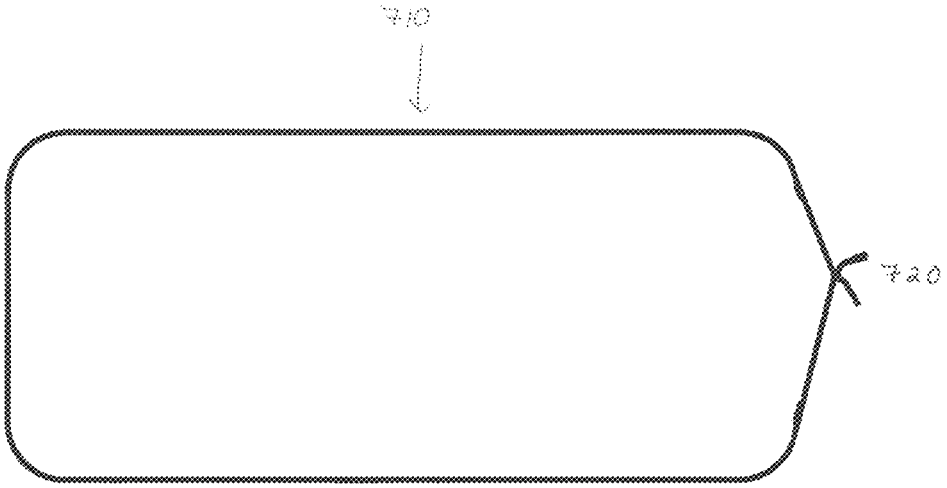
FIG. 21 is the front view of the bag that can be used to contain and transport the exercise board.

FIG. 21 shows a carrying bag for the board generally designated as 710. In some embodiments, the board can be contained within a separately designed bag designed for transport. In some embodiments the bag may enclose around the handholds intended for user transport, leaving the handholds on the board itself available for use. In some embodiments, the bag may zip shut or partially zip shut. In some embodiments, the bag may close partially or completely with VELCRO® tabs. In some embodiments, the bag may enclose around the entire board and the bag may contain its own loops, handholds, or grips 720 for the user to hold during transport. The user of the board herself may transport the bag or the physical therapist may transport the board to provide therapy for clients. The embodiment choice may depend on the physical capacity of the user.

The boards 10, 110, 210, 410, 510 and 610 can be constructed in a variety of sizes to accommodate users of different sizes. In embodiments, the length of the board in its unfolded configuration is within the range of about 36 inches to about 84 inches, about inches to about 80 inches, or about 68 inches to 77 inches. In embodiments, the width of the board is within the range of about 18 inches to about 42 inches, about 22 inches to about 35 inches, or about 27 inches to about 29 inches. In embodiments, the thickness of segments 12 and 14, defined by side surfaces 46, would be within the range of about 0.5 inches to about 3 inches, or about 0.75 inches to about 2 inches, or about 1 inch to about 1.5 inches.

In embodiments, the thickness of the cushion attached to the board is within the range of about 0.25 inches to about 3.0 inches, or about 0.5 inches to about 2.0 inches, or about 0.75 inches to about 1.75 inches. In some embodiments, the ratio of the thickness of the board to the thickness of the cushion is in the range of about 1.5:1 to about 10:1.

For portability, the preferred embodiment of the exercise board has a total weight in the range of about 5 to about 20 pounds, or about 8 to about 18 pounds, or about 10 to about 15 pounds.

The thermoplastic material may be a polymer, metal, foam, or composite material, or combination thereof and for all embodiments may contain reinforcing particulate filler material, including organic material, inorganic material, or both. The boards 10, 110, 210, 410, 510 and 610 may be made from a wipeable thermoplastic material such as a (non-limiting examples including polyethylene, polypropylene, acrylonitrile butadiene styrene, polycarbonate, polyvinyl chloride) resin or other suitable thermoplastic material. Alternatively, the board made be made of thermoset material (non-limiting examples including polyurethane, epoxy). The segments of the preferred embodiment are made of a solid piece of thermoplastic material. Another embodiment may have segments made of vacuum formed thermoplastic or thermoset material forming an exterior shell with or without an interior reinforcing structure within each segment.

It is specifically intended that the present invention not be limited to the embodiments and illustrations contained herein, but include modified forms of those embodiments including portions of the embodiments and combinations of elements of different embodiments as come within the scope of the following claims.

What is claimed is:

1. An exercise board comprising:

a foldable rigid support component configured to be of sufficient length to support a user lying horizontally, the rigid support component comprising at least a first segment and a second segment with each segment comprising an upper side surface and a lower side surface, each of the first segment and the second segment comprising at least one of a thermoplastic material and a thermoset material and having a reinforcing frame extending along a length and a width thereof;

a first cushion mounted to the upper side surface of the first segment and a second cushion mounted to the upper side surface of the second segment; and at least one hinge connecting the first segment and the second segment that allows the exercise board to lay flat in a functional exercise position with substantially no gap between the first segment and the second segment at a region of the exercise board adjacent to the at least one hinge when the exercise board is in both folded and unfolded configurations, the at least one hinge allowing the board to fold closed during non-use with the lower side surface of the first segment in contact with the lower side surface of the second segment.

2. The exercise board of claim 1 wherein the rigid support component has a length in a range of about 36 inches to about 84 inches.

3. The exercise board of claim 1 wherein each of the first segment and the second segment of the rigid support component has a depth of about 0.25 to about 3.0 inches.

4. The exercise board of claim 1, wherein the reinforcing frame of each of the first segment and the second segment comprises a polymer, a metal, a foam, a composite material, or a combination thereof.

5. The exercise board of claim 1, further comprising a handhold cutout located along the length of at least one of the first segment and the second segment.

6. The exercise board of claim 1, further comprising a handhold formed on at least one corner of the rigid support component.

7. The exercise board of claim 1, wherein each of the first cushion and the second cushion comprises a continuous piece of foam with a thickness in a range of about 0.25 inches to about 3.0 inches.

8. The exercise board of claim 1, wherein the rigid support component is formed from a non-porous wipeable material.

9. The exercise board of claim 1, wherein each of the first cushion and the second cushion is attached to the rigid support component with hook and loop fasteners.

10. The exercise board of claim 1 wherein the hinge is a locking hinge connected to inner end portions of the first and second segments, respectively.

11. A method of using the exercise board of claim 1, comprising the steps of:

a. obtaining the exercise board in a folded position thereof, b. unfolding the exercise board into a fully extended position thereof;

c. placing the exercise board in the fully extended position onto a bed or other platform, orienting the exercise board so that the cushion faces up; and d. locking the hinge.

12. The method of claim 11 further comprising the step of:

e. engaging in exercise atop the exercise board in the fully extended position.

13. The method of claim 12, further comprising the steps of:

f. folding the exercise board into the folded position; and g. placing the exercise board in the folded position in a storage location.

14. The exercise board of claim 1, further comprising a plurality of fasteners including at least one of holes, hooks, ties, hook and loop fasteners, magnets, or buckles to connect a resistance apparatus to the exercise board, the plurality of fasteners being connected to at least one of sides of the exercise board and corners of the exercise board.

15. The exercise board of claim 14, wherein the resistance apparatus comprises at least one of an elastic or nonelastic band, strap, or belt.

16. The exercise board of claim 15, wherein the resistance apparatus has a length in a range of 22 inches to 160 inches, and a width in a range of 0.3 inches to 30 inches.

17. The exercise board of claim 1, wherein the reinforcing frame of each of the first segment and the second segment comprises an interior reinforcing frame.

18. An exercise board comprising:

a foldable rigid support component configured to be of sufficient length to support a user lying horizontally, the rigid support component comprising a first segment, a second segment, and a third segment with each segment comprising an upper side surface and a lower side surface, each of the first segment, the second segment, and the third segment being formed from at least one of a thermoplastic material and a thermoset material and having a reinforcing frame extending along a length and a width thereof;

a first cushion mounted to the upper side surface of the first segment, a second cushion mounted to the upper side surface of the second segment, and a third cushion mounted to the upper side surface of the third segment; and a first hinge connecting the first segment and the second segment, and a second hinge connecting the second segment and the third segment, the first hinge allowing the exercise board to lay flat in a functional exercise position with substantially no gap between the first segment and the second segment at a region of the exercise board adjacent to the first hinge when the exercise board is in both folded and unfolded configurations, the second hinge allowing the exercise board to lay flat in the functional exercise position with substantially no gap between the second segment and the third segment at a region of the exercise board adjacent to the second hinge when the exercise board is in both the folded and unfolded configurations, the first hinge and the second hinge allowing the board to fold closed during non-use with the lower side surface of the first segment and the lower side surface of the third segment in contact with the lower side surface of the second segment.

19. The exercise board of claim 18, wherein the reinforcing frame of each of the first segment, the second segment, and the third segment comprises an interior reinforcing frame.

20. The exercise board of claim 18, wherein the reinforcing frame of each of the first segment, the second segment, and the third segment comprises a polymer, a metal, a foam, a composite material, or a combination thereof.

* * * * *